US012618555B2

(12) United States Patent
Weaver et al.

(10) Patent No.: US 12,618,555 B2
(45) Date of Patent: May 5, 2026

(54) ADJUSTABLE BURNER NOZZLE FOR MULTIPLE FUELS

(71) Applicant: Honeywell International Inc., Charlotte, NC (US)

(72) Inventors: Joshua J. Weaver, Yorktown, IN (US); Bradley M. Wright, Hartford City, IN (US); Edward Lovett, Parker City, IN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 455 days.

(21) Appl. No.: 18/134,191

(22) Filed: Apr. 13, 2023

(65) Prior Publication Data

US 2024/0344695 A1 Oct. 17, 2024

(51) Int. Cl.

| | |
|---|---|
| ***F23D 14/04*** | (2006.01) |
| ***F23D 14/62*** | (2006.01) |
| ***F23N 3/00*** | (2006.01) |

(52) U.S. Cl.

CPC ..... *F23D 14/04* (2013.01); *F23D 14/62* (2013.01); *F23N 3/007* (2013.01); *F23D 2900/14481* (2013.01)

(58) Field of Classification Search

CPC ..... F23L 13/06

See application file for complete search history.

(56) References Cited

U.S. PATENT DOCUMENTS

| | | | | | |
|---|---|---|---|---|---|
| 14,414 | A * | 3/1856 | Shaw | F23D 11/10 | 239/553.3 |
| 556,628 | A * | 3/1896 | Hallas | F23D 14/48 | 431/355 |
| 629,285 | A * | 7/1899 | Bachmeyer | F23D 14/48 | 431/355 |
| 701,025 | A * | 5/1902 | Eldridge | C04B 35/62231 | 431/110 |
| 810,870 | A * | 1/1906 | Kirkwood | F23D 14/26 | 431/349 |
| 928,497 | A * | 7/1909 | Carnahan | F23D 14/48 | 431/355 |
| 1,337,801 | A * | 4/1920 | Shannon | F23D 14/48 | 137/893 |
| 1,515,172 | A * | 11/1924 | Ronstrom | F23D 14/00 | 239/416.5 |
| 1,537,335 | A * | 5/1925 | Cross | F23D 14/48 | 431/326 |
| 1,736,990 | A * | 11/1929 | Le | F23D 11/04 | 431/182 |

(Continued)

FOREIGN PATENT DOCUMENTS

| | | |
|---|---|---|
| EP | 2153042 B1 | 7/2018 |
| EP | 3816120 A1 | 5/2021 |

*Primary Examiner* — Jorge A Pereiro

(74) *Attorney, Agent, or Firm* — Ingrassia Fisher & Lorenz LLP

(57) ABSTRACT

A fuel nozzle apparatus can include a nozzle that functions with two or more modes of operation with respect to a group of fuels, and an air shroud fixed over the nozzle. The air shroud blocks air through the nozzle or allows air through the nozzle in a predefined pattern. When a position of the air shroud is varied, the amount of the air and the location of the air into the nozzle is changed to facilitate the two or more modes of operation with respect to the group of fuels.

20 Claims, 5 Drawing Sheets

Mode 1

Mode 2

(56) References Cited

U.S. PATENT DOCUMENTS

| | | | | | |
|---|---|---|---|---|---|
| 1,870,013 | A * | 8/1932 | Keenan, Jr. | F23D 1/00 | 431/182 |
| 2,014,665 | A * | 9/1935 | Palmer | F23D 14/04 | 239/456 |
| 2,068,567 | A * | 1/1937 | Palmer | F23D 14/64 | 431/114 |
| 2,132,551 | A * | 10/1938 | Wood | F23D 14/00 | 239/419 |
| 2,661,157 | A * | 12/1953 | Reichelderfer | F23D 14/60 | 431/89 |
| 2,989,119 | A * | 6/1961 | Burt | F23C 7/008 | 431/353 |
| 3,164,200 | A * | 1/1965 | Reed | F23D 14/02 | 431/284 |
| 3,663,153 | A | 5/1972 | Bagge et al. | | |
| 4,902,222 | A | 2/1990 | van Belle | | |
| 4,998,877 | A * | 3/1991 | Schilling | F23D 11/36 | 431/114 |
| 5,611,684 | A * | 3/1997 | Spielman | F23D 14/34 | 239/431 |
| 5,647,739 | A | 7/1997 | McDonald | | |
| 5,664,881 | A * | 9/1997 | Hawkins | E01C 19/1036 | 366/4 |
| 6,220,188 | B1 * | 4/2001 | Boutrup | F23C 7/008 | 110/297 |
| 7,566,218 | B2 | 7/2009 | Aldrich | | |
| 7,901,204 | B2 | 3/2011 | Stephens et al. | | |
| 9,328,917 | B2 * | 5/2016 | Yousif | F23D 1/00 | |
| 2012/0023951 | A1 | 2/2012 | Parsania et al. | | |
| 2016/0102857 | A1 * | 4/2016 | Khadem | F23C 5/32 | 431/9 |
| 2022/0034503 | A1 * | 2/2022 | Ogawa | F24H 1/0027 | |

* cited by examiner

ADJUSTABLE BURNER NOZZLE FOR MULTIPLE FUELS

TECHNICAL FIELD

Embodiments are generally related to the field of industrial heating processes and systems that utilize natural gas combustion. Embodiments also relate to industrial burners and fuel nozzles used for the mixing of fuel and air in a controller manner. Embodiments further relate to adjustable burner nozzles that can operate with multiple fuels.

BACKGROUND

Fuel nozzles are important components of industrial burners used in the mixing of fuel and air in a controlled manner and the delivery of the mixture to the combustion chamber of the burner. These nozzles come in various shapes, sizes, and materials, depending on the type of burner, the fuel being used, and the specific requirements of the application.

A fuel nozzle is typically mounted in the burner body, and fuel is supplied to the nozzle through a piping system. The air required for combustion enters the burner through an air inlet, and the fuel and air are mixed and ignited, creating heat that is used for various industrial processes.

Typically, industrial burner fuel nozzles are made from materials such as brass, stainless steel, or ceramic, which can withstand high temperatures and corrosive environments. They are designed to create a precise mixture of fuel and air, which ensures efficient combustion and reduced emissions.

A high proportion of industrial heating processes utilize natural gas combustion, however increasingly companies which operate these processes are looking to alternate gaseous fuels to reduce their carbon footprint or to mitigate fuel supply risks. Conventional fuel nozzles for industrial burners are designed for one fuel type and are not capable of operating on multiple fuels without physical modification to the fuel nozzle. One example of such a conventional nozzle is disclosed in non-limiting U.S. Pat. No. 5,646,739, which is incorporated herein by reference in its entirety.

For an industrial process with a conventionally designed burner to switch from one fuel to another the entire process must go down while the burner nozzle is changed. This represents a major barrier to many companies and often makes the switch to an alternate fuel impractical. Alternate fuels currently do not enjoy the reliability in availability that natural gas does, therefore their presence is often intermittent. For example, a hydrogen electrolyzer system which is powered by wind or solar. This system will only generate hydrogen at certain times of day or the capacity of such a system is seasonally dependent. This variability in supply is not well suited to conventional burners which require physical modification to properly operate with multiple fuels.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

It is, therefore, one aspect of the embodiments to provide methods, systems and devices for an approved fuel nozzle apparatus for use with industrial burners.

It is another aspect of the embodiments to provide for an adaptable fuel nozzle for an industrial burner, which can facilitate the use of two gaseous fuels.

It is also an aspect of the embodiments to provide for a fuel nozzle apparatus that has two modes of operation, which can be selected by manual or automatic means.

The aforementioned aspects and other objectives can now be achieved as described herein. In an embodiment, a fuel nozzle apparatus, can include a nozzle that functions with at least two modes of operation with respect to a plurality of fuels, and an air shroud fixed over the nozzle, wherein the air shroud blocks air through the nozzle or allows air through the nozzle in a predefined pattern. When a position of the air shroud is varied, the amount of the air and the location of the air into the nozzle can be changed to facilitate the at least two modes of operation with respect to the plurality of fuels.

In an embodiment, the at least two modes of operation can be selected manually.

In an embodiment, the at least two modes of operation can be selectable manually by manually actuating a selector switch or using a linkage driven by an actuator fixed to the selector switch.

In an embodiment, the at least two modes of operation can be selectable automatically with an actuator in automatic mode dependent upon an availability of at least one fuel among the plurality of fuels.

In an embodiment, the nozzle can comprise an adaptable fuel nozzle that can facilitate the use of two gaseous fuels for a burner.

In an embodiment, either of the at least two selectable modes of operation may be triggered by a burner control system associated with the burner, thereby allowing the burner to transition from one fuel to another fuel among the two at least fuels automatically without a shutdown of the burner control system.

In an embodiment, the air can be adjusted prior to a mixture of the air with the plurality of fuels.

In an embodiment, the plurality of fuels may comprise different types of fuels.

In an embodiment, the air shroud can be subject to a linear movement in an axial direction in which the position of the air shroud may be varied linearly.

In an embodiment, a fuel nozzle apparatus can include a nozzle that functions with at least two modes of operation with respect to a plurality of fuels, and an air shroud subject to a linear movement in an axial direction in which the position of the shroud can be varied linearly, wherein the air shroud surrounds the nozzle and blocks air through the nozzle or allows air through the nozzle in a predefined pattern, and wherein when a position of the air shroud is varied, an amount of the air and a location of the air into the nozzle can be changed to facilitate the at least two modes of operation with respect to the plurality of fuels.

In an embodiment, a method of operating a fuel nozzle apparatus, can involve providing a nozzle that functions with at least two modes of operation with respect to a plurality of fuels, fixing an air shroud over the nozzle wherein the air shroud blocks air through the nozzle or allows air through the nozzle in a predefined pattern, and varying a position of the air shroud wherein an amount of the air and a location of the air into the nozzle is changed to facilitate the at least two modes of operation with respect to the plurality of fuels.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the detailed description of the invention, serve to explain the principles of the present invention.

Like reference symbols or reference numerals in the various drawings may indicate like elements.

DETAILED DESCRIPTION

Figure 1:
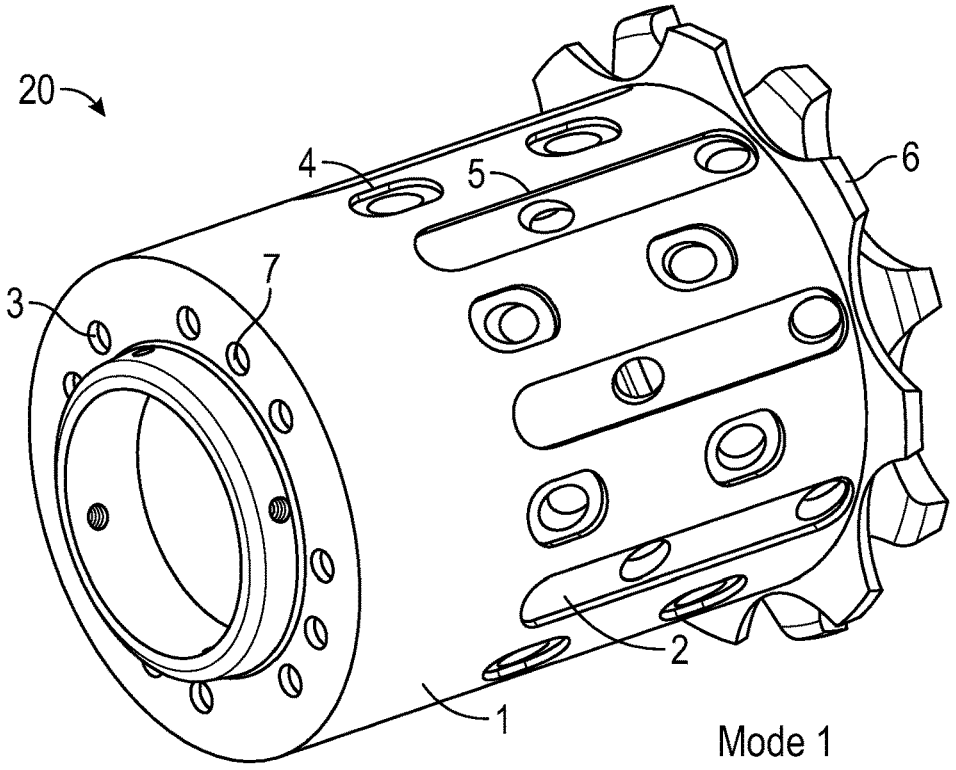
FIG. 1 illustrates a perspective view of a nozzle that can burn hydrogen in a first mode, in accordance with an embodiment.

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in an embodiment" or "in one embodiment" or "in an example embodiment" and variations thereof as utilized herein may or may not necessarily refer to the same embodiment. Similarly, the phrase "in another embodiment" or "in another example embodiment" and variations thereof as utilized herein may or may not necessarily refer to a different embodiment. It is intended, for example, that claimed subject matter may include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. The term "at least one" may refer to "one or more". For example, "at least one widget" may refer to "one or more widgets."

Embodiments relate to an improved fuel nozzle apparatus which can function as an adaptable fuel nozzle for industrial burners and facilitates the use of two or more gaseous fuels (e.g., hydrogen and natural gas, or coke oven gas and natural gas etc.). As will be discussed in greater detail below, the fuel nozzle has two modes of operation which can be selected by manual or automatic means. Either of the modes of operation can be triggered by a burner control system, thereby allowing the burner to transition from one fuel to another automatically with no shutdown of the process required. This will give the customer or use the flexibility to use alternate fuels when available, and switch to natural gas if the alternate fuel becomes unavailable.

Figure 2:
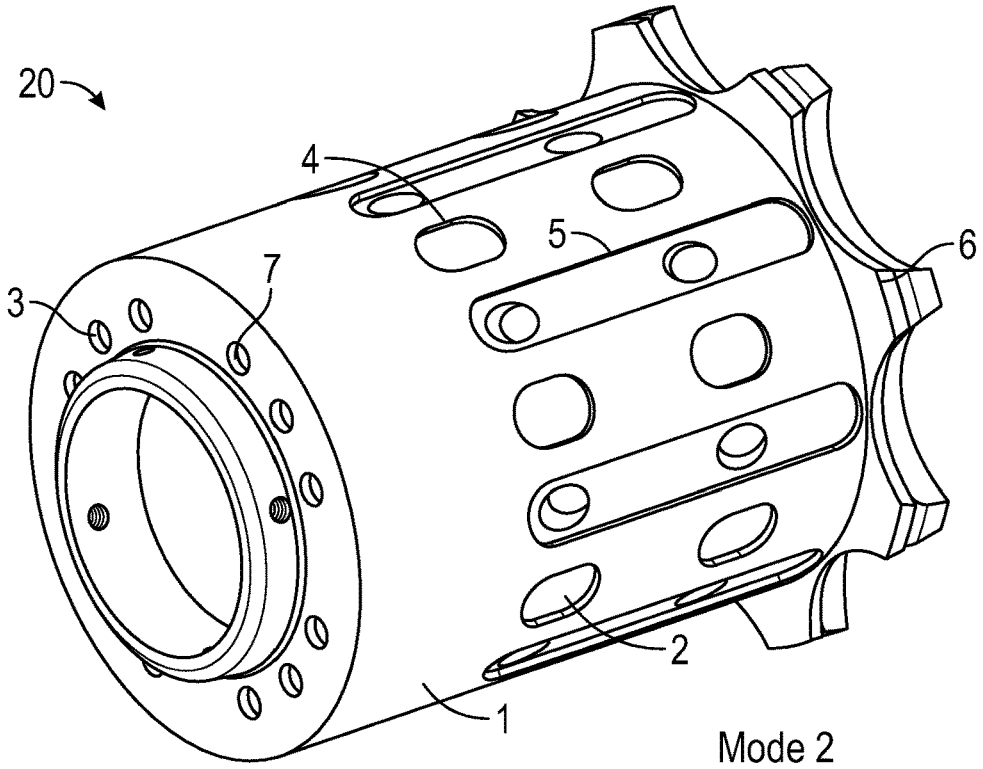
FIG. 2 illustrates a perspective view of the nozzle depicted in FIG. 1 with an air shroud set in a second mode for natural gas operation, in accordance with an embodiment.

FIG. 1 illustrates a perspective view of a fuel nozzle apparatus 20 that can burn hydrogen in a first mode, in accordance with an embodiment. FIG. 2 illustrates a perspective view of the nozzle 20 depicted in FIG. 1 with an air shroud set in a second mode for natural gas operation, in accordance with an embodiment. The fuel nozzle apparatus 20 can be configured to allow for two or more selectable modes of operation for two more fuels, respectively.

The fuel nozzle apparatus 20 can include an air shroud 1 and a nozzle 2, which can be configured in a manner that can either block air through the nozzle 2 or allow air through the nozzle 2 in a predefined pattern. When the rotational position of the air shroud 1 is changed, the amount of air and location of air into the nozzle 2 is also changed. FIG. 1 shows the nozzle 2 configured to burn hydrogen in a first mode (Mode 1). FIG. 2 shows the same nozzle 2 with the air shroud 1 set in Mode 2 for natural gas operation.

From FIG. 1 and FIG. 2, it can be seen that slots 4 and 5 in the air shroud 1 either allow or block air flow through the nozzle. In the hydrogen mode of operation (Mode 1) shown in FIG. 1 more air enters the nozzle 2 to promote cool operation of the nozzle 2 and impart more momentum to the mixture in the axial direction. In the natural gas mode of operation (Mode 2) shown in FIG. 2, less air is needed in the nozzle 2 to maintain a cool operation, and the amount of air required to maintain the cool operation burning hydrogen would produce instability when burning natural gas, so the air into the nozzle 2 is reduced. Additionally, the final ring of the nozzle 2 contains air slots which direct air into the flame as it exits the nozzle 2. The air shroud 1 mirrors the geometry of slots 6 and depending on the mode selected, restricts air flow through these slots, or allows unrestricted air flow.

By allowing for a reduced pressure drop at the final ring of the nozzle 2, a higher proportion of the air can be directed into the final stage of the nozzle 2 rather than into the second stage. For hydrogen operation more air may be needed within the nozzle 2, so the slots are restricted. Finally, there are two hole patterns 3 and 7 at the rear of the air shroud 1, which either can allow unrestricted air flow through the first stage of the nozzle or can block air flow completely. By reducing the amount of air in the first stage when firing hydrogen, the likelihood of flashback into the inlet section of the nozzle 2 can be reduced.

Figure 3:
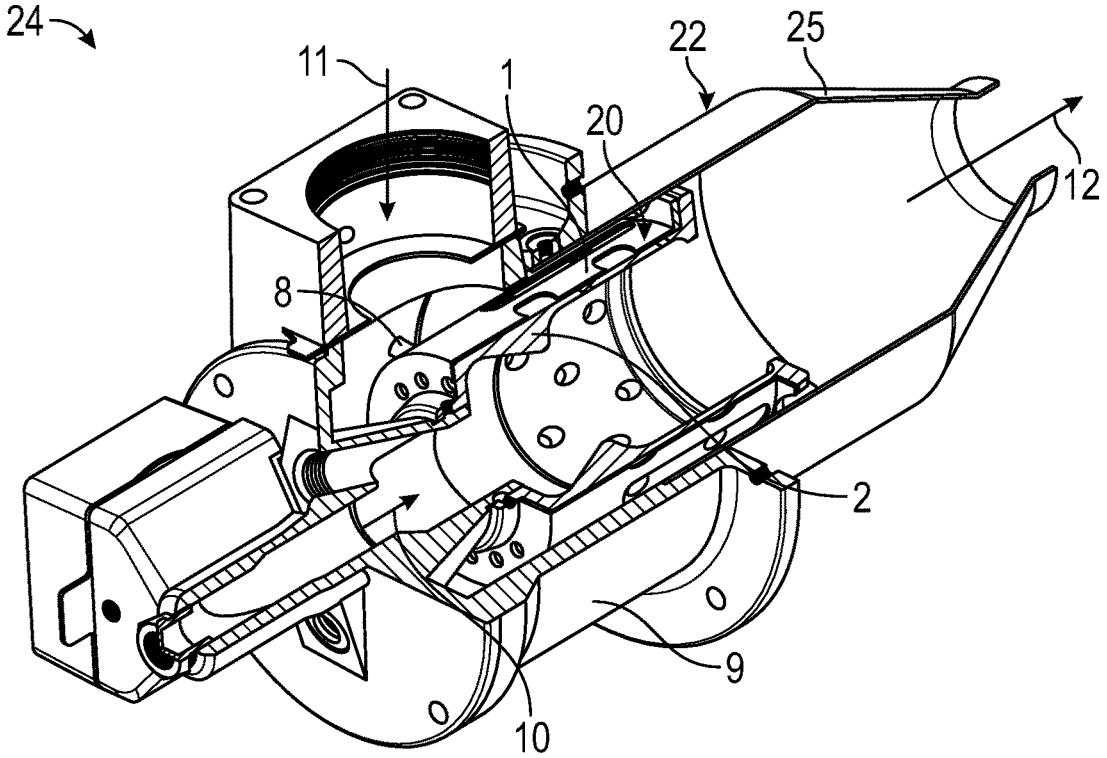
FIG. 3 illustrates a perspective sectional view of a burner that includes the nozzle shown in FIG. 1 within a discharge sleeve, in accordance with an embodiment.

FIG. 3 illustrates a perspective sectional view of a burner 24 that can include the fuel nozzle apparatus 20 contained at least partially within a discharge sleeve 22 including a tapered conical end 25 and an outlet 12, in accordance with an embodiment. The burner 24 additionally can include an inlet 11 and a premix chamber 10. A burner housing 9 can contain the premix chamber 10 and also can maintain at least a part of the fuel nozzle apparatus 20. The fuel nozzle apparatus 20 can connect to the premix chamber 10. An extension 8 of the fuel nozzle apparatus 20 can engage through the burner housing 9.

Figure 4:
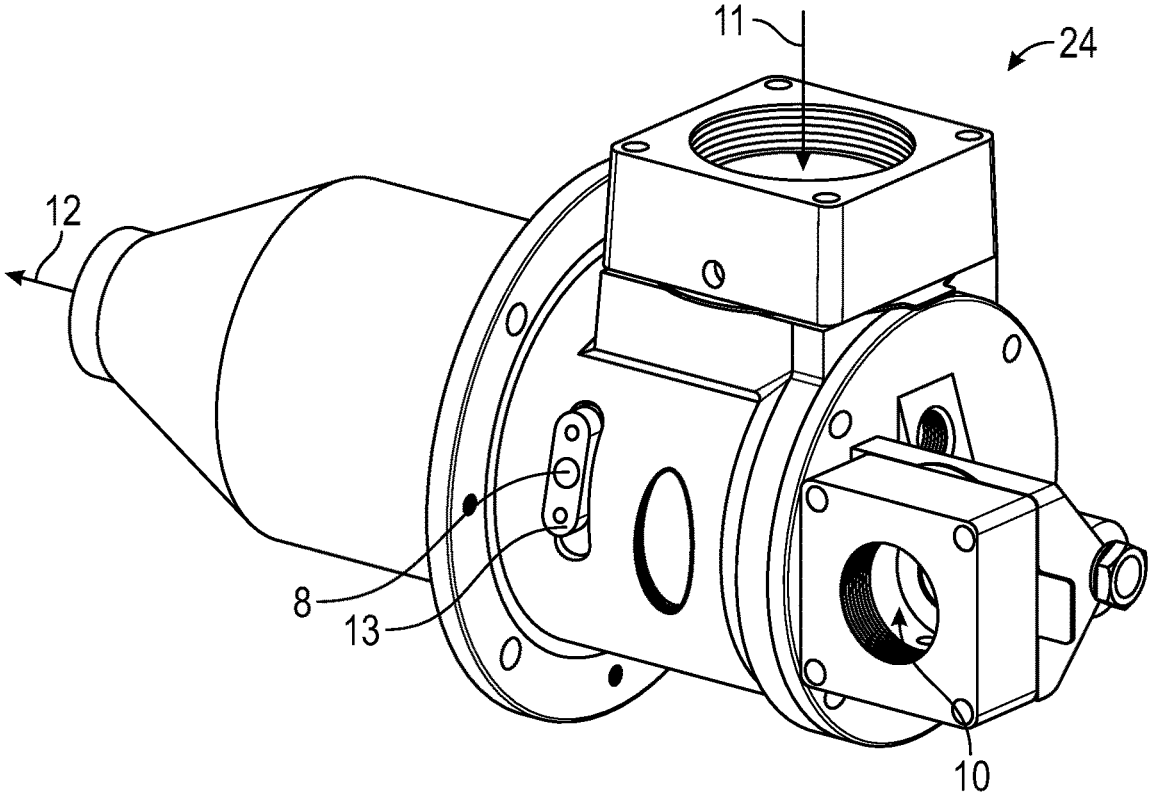
FIG. 4 illustrates an opposing and perspective view of the burner shown in FIG. 3, in accordance with an embodiment.

FIG. 4 illustrates an opposing and perspective view of the burner 24 shown in FIG. 3, in accordance with an embodiment. FIG. 4 depicts the inlet 11 and the outlet 12, along with the extension 8 and a selector switch 13, wherein the selector switch 13 is located on the burner housing 9.

The mode of operation can be set manually by actuating the selector switch 13 or by using a linkage driven by an actuator fixed to the selector switch. Using an actuator can allow for an automatic mode selection depending on the availability of the alternate fuel. The transition between mode 1 and mode 2 can also be controlled such that the hole patterns in the nozzle are partially covered (e.g., see FIG. 9).

By partially covering the hole patterns the amount of air that can pass through the hole pattern 3 and 7 is also controlled. This would provide the ability to tune the nozzle 2 for optimal operation with a variety of fuel mixtures. Another way to utilize this invention is by linear actuation of the air shroud 1. This linear movement in the axial direction can derive from manual or automatic means (e.g., see FIG. 7).

Figure 5:
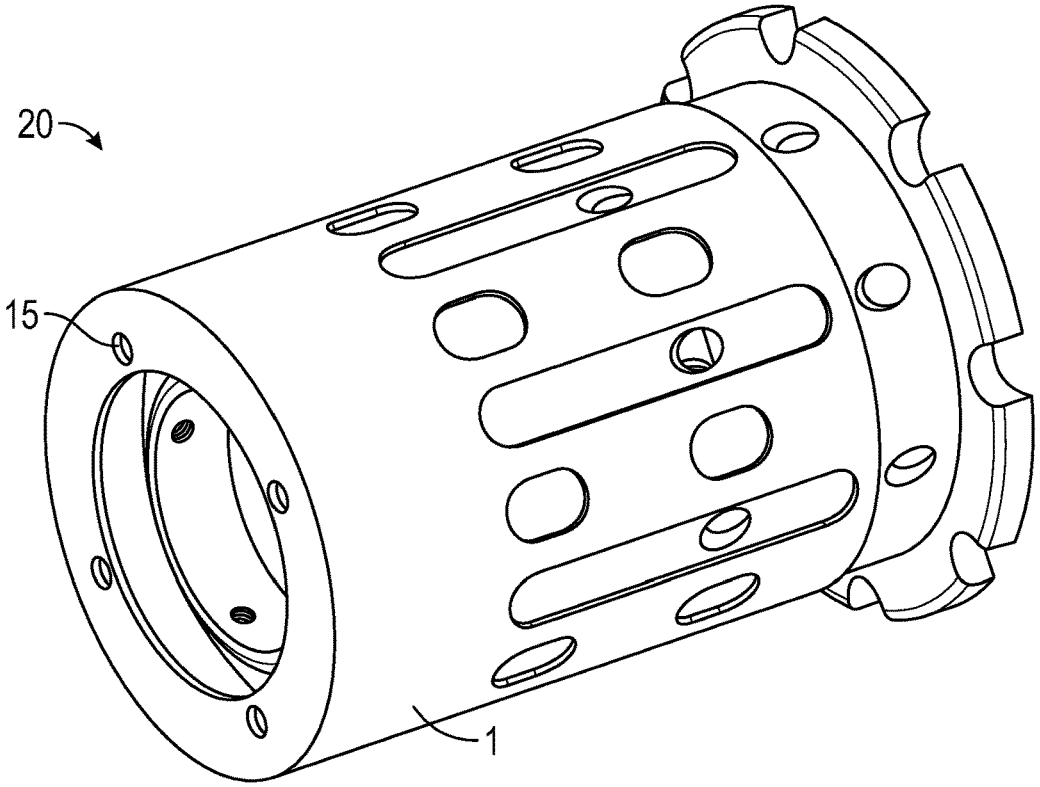
FIG. 5 illustrates a perspective view of the nozzle in a natural gas operating mode, in accordance with an embodiment.
Figure 6:
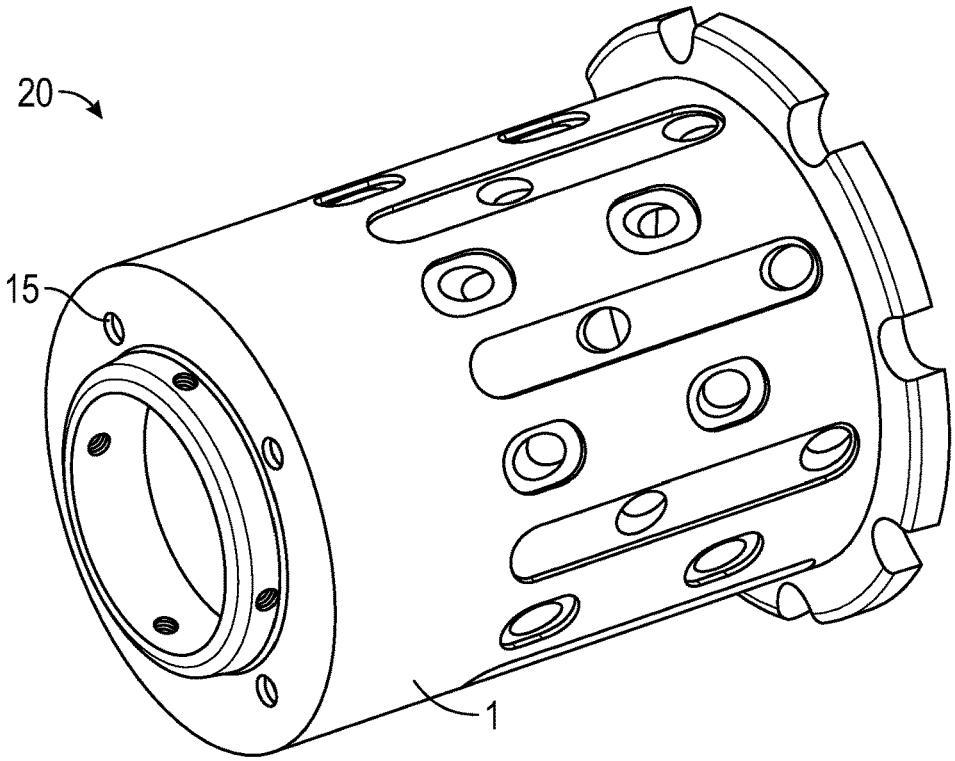
FIG. 6 illustrates a perspective view of the nozzle in a hydrogen gas operating mode, in accordance with an embodiment.

FIG. 5 illustrates a perspective view of the fuel nozzle apparatus 20 in a natural gas operating mode, in accordance with an embodiment. FIG. 6 illustrates a perspective view of the fuel nozzle apparatus 20 in a hydrogen gas operating mode, in accordance with an embodiment. FIG. 5 and FIG. 6 depict the natural gas and hydrogen modes of operation respectively. In the natural gas mode of operation, the air shroud 1 can be pulled toward the fuel inlet of the nozzle 2 covering a certain amount of air holes in the nozzle 2, and at the same time uncovering hole in the rear of the nozzle. In this approach, the area of the slots at the end of the nozzle 2 are not controlled as they are in the rotational implementation.

FIG. 6 indicates that as the air shroud 1 is actuated axially toward the discharge of the nozzle 2 certain holes are uncovered in a second chamber to create the proper air distribution for hydrogen operation. The rear of the air shroud 1 also covers certain air holes leading to a first chamber which leaves a hole pattern 15 as the only air path into that chamber. The transition between modes of operation can be controlled in a manner in which the air can be partially blocked in certain holes. By partially covering these holes, the performance of the nozzle 2 can be tuned based on the exact fuel mixture required. The degree to which each hole may be blocked can be infinitely variable creating the exact air fuel mixture characteristics for the specific fuel mixture provided.

Figure 7:
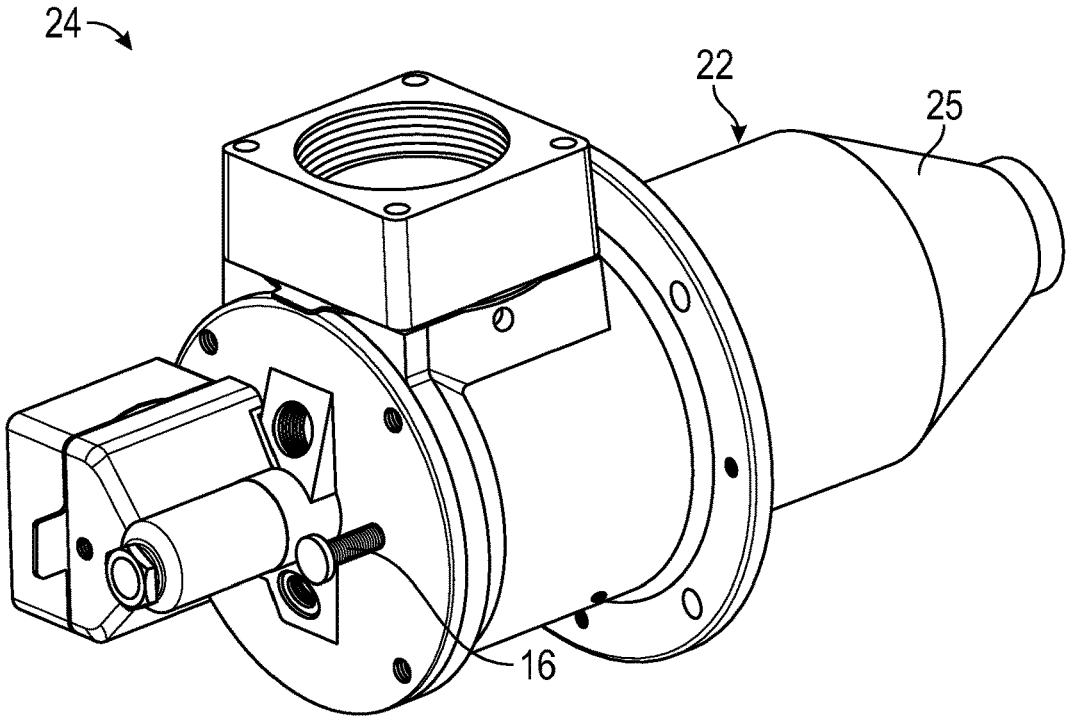
FIG. 7 illustrates a perspective view of the burner with a threaded rod that can be either manually turned, or turned with an actuator to move the air shroud in the axial direction to allow for the selection of modes of operation, or any point in between those modes, in accordance with an embodiment.

FIG. 7 illustrates a perspective view of the burner 24 with a threaded rod 16 that can be either manually turned or turned with an actuator to move the air shroud 1 in the axial direction to allow for the selection of modes of operation, or any point in between those modes, in accordance with an embodiment.

Figure 8:
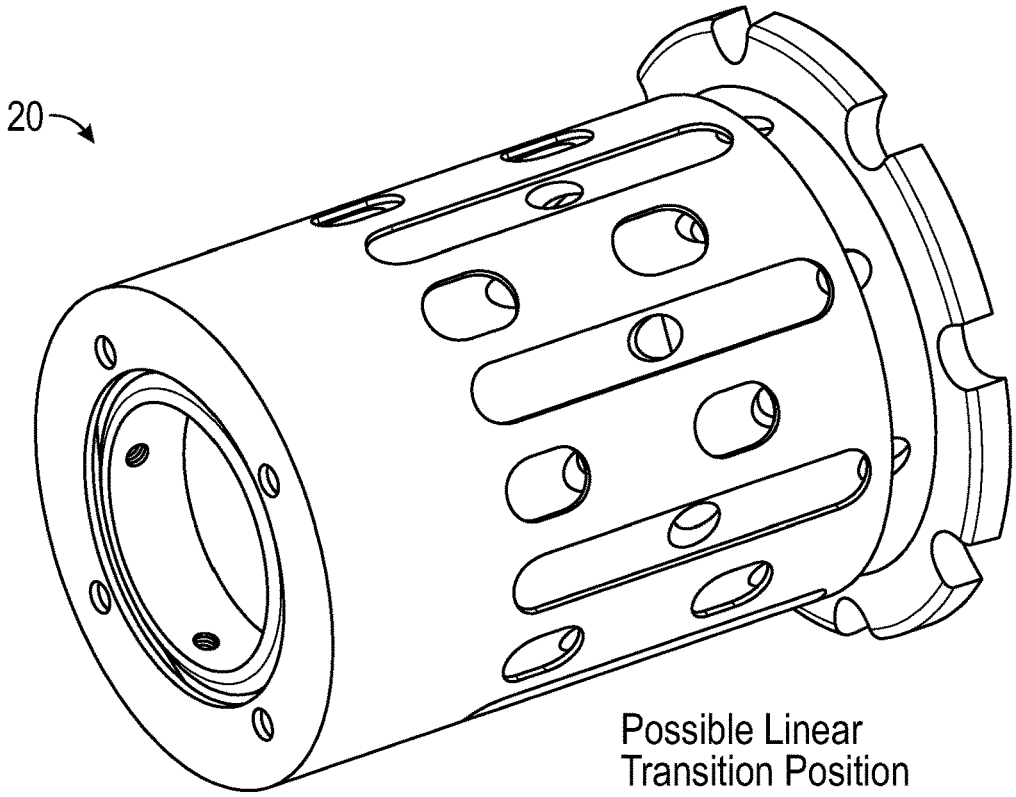
FIG. 8 illustrates a perspective view of the nozzle with a possible linear transition position, in accordance with an embodiment.
Figure 9:
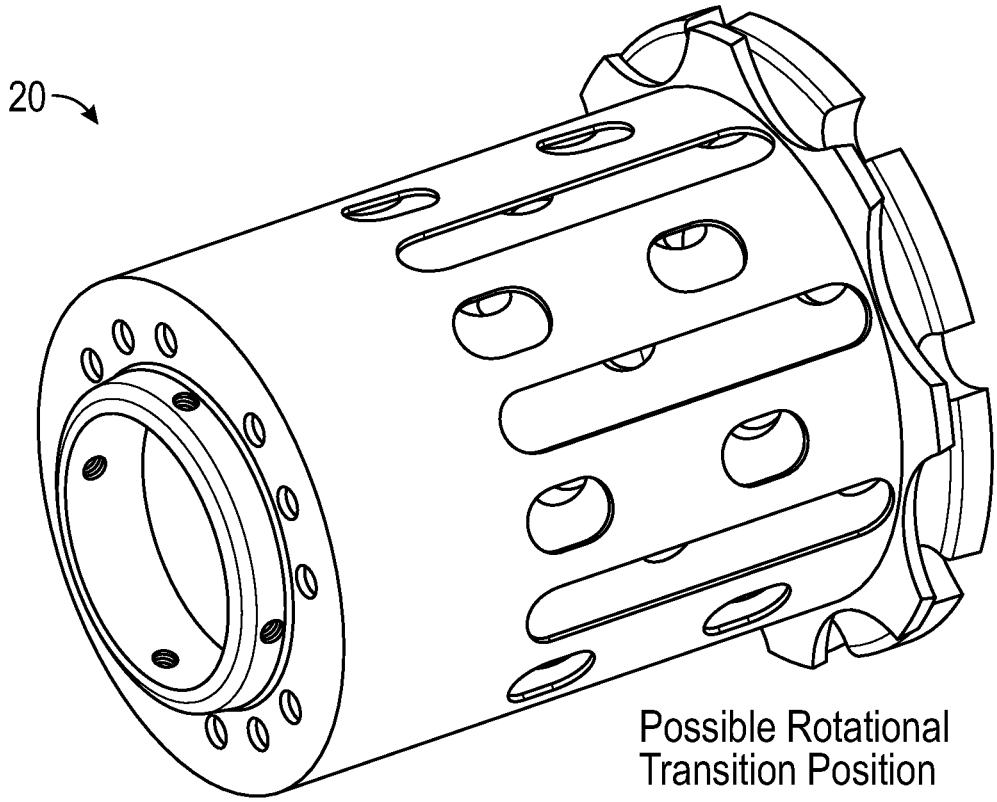
FIG. 9 illustrates a perspective view of the nozzle with a possible rotational transition position, in accordance with an embodiment.

FIG. 8 illustrates a perspective view of the fuel apparatus 20 with a possible linear transition position, in accordance with an embodiment. FIG. 9 illustrates a perspective view of the fuel apparatus 20 with a possible rotational transition position, in accordance with an embodiment.

The nozzle 2 can function as an adaptable fuel nozzle for an industrial burner which can facilitate the use of two gaseous fuels (e.g., hydrogen and natural gas, or coke oven gas and natural gas etc.). The fuel nozzle apparatus 20 has two modes of operation which can be selected by manual or automatic means as discussed previously. Either mode of operation can be triggered by a burner control system, thereby allowing the burner 24 to transition from one fuel to another automatically with no shutdown of the process required. This will give a customer the flexibility to use alternate fuels when available, and switch to natural gas if the alternate fuel becomes unavailable. Conventional industrial burners with manual or automatically adjustable fuel nozzles have used a mixture of fuel and air shaped by manually adjusting the axial location of a conical end which thereby reduces or increases the annular gap formed between the conical end and the primary air housing. This is done to increase mixing of fuel and air and effect the flame shape.

The embodiments differ from these approaches by the air alone being adjusted prior to mixture with the fuel. Furthermore, the location of where the air is introduced to the fuel is being varied, with the goal of influencing the fuel and air mixing characteristics of the nozzle. Conventional devices have been primarily concerning with the velocity of the fuel and air mixture as it exits the nozzle, with the goal of shaping the flame. The amount of air entering the nozzle has been adjusted as the burner thermal output is varied. The goal of this adjustment is to provide the proper air fuel ratio as the thermal output of the burner is changed. Therefore, the location of the air in the nozzle is not changed, only the amount. The embodiments, however, offer the ability to change where air is introduced to the fuel in the nozzle as well as the amount. Different fuels can create different flame dynamics in a nozzle. The disclosed embodiments thus can demonstrate the importance of where the air is introduced and how much air is introduced.

Based on the foregoing, it can be appreciated that a number of different embodiments are disclosed herein. For example, in one embodiment, a fuel nozzle apparatus can include a nozzle that functions with at least two modes of operation with respect to a plurality of fuels, and an air shroud fixed over the nozzle, wherein the air shroud blocks air through the nozzle or allows air through the nozzle in a predefined pattern, and wherein when a position of the air shroud is varied, and an amount of the air and a location of the air into the nozzle is changed to facilitate the at least two modes of operation with respect to the plurality of fuels.

In an embodiment, the at least two modes of operation can be selectable manually.

In an embodiment, the at least two modes of operation may be selectable manually by manually actuating a selector switch or using a linkage driven by an actuator fixed to the selector switch.

In an embodiment, the at least two modes of operation can be selectable automatically with an actuator in automatic mode dependent upon an availability of at least one fuel among the plurality of fuels.

In an embodiment, the nozzle comprises an adaptable fuel nozzle that can facilitate a use of two gaseous fuels for a burner.

In an embodiment, either of the at least two selectable modes of operation can be triggered by a burner control system associated with the burner, thereby allowing the burner to transition from one fuel to another fuel among the two at least fuels automatically without a shutdown of the burner control system.

In an embodiment, the air can be adjusted prior to a mixture of the air with the plurality of fuels.

In an embodiment, the plurality of fuels can comprise different types of fuels.

In an embodiment, the air shroud is subject to a linear movement in an axial direction in which the position of the air shroud is varied linearly.

In an embodiment, a fuel nozzle apparatus, can include a nozzle that functions with at least two modes of operation with respect to a plurality of fuels, and an air shroud subject to a linear movement in an axial direction in which the position of the shroud is varied linearly, wherein the air shroud surrounds the nozzle and blocks air through the nozzle or allows air through the nozzle in a predefined pattern. The position of the air shroud can be varied, and the amount of the air and the location of the air into the nozzle can be changed to facilitate the at least two modes of operation with respect to the plurality of fuels.

In an embodiment, a method of operating a fuel nozzle apparatus can involve providing a nozzle that functions with at least two modes of operation with respect to a plurality of fuels; fixing an air shroud over the nozzle wherein the air shroud blocks air through the nozzle or allows air through the nozzle in a predefined pattern; and varying a position of the air shroud wherein an amount of the air and a location of the air into the nozzle is changed to facilitate the at least two modes of operation with respect to the plurality of fuels.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A fuel nozzle apparatus, comprising:

a nozzle that functions with at least two modes of operation with respect to a plurality of fuels; and an air shroud fixed over the nozzle, wherein the air shroud blocks air through the nozzle or allows air through the nozzle in a predefined pattern, wherein when a position of the air shroud is varied, an amount of the air and a location of the air into the nozzle is changed to facilitate the at least two modes of operation with respect to the plurality of fuels wherein, in a first mode of operation of the at least two modes of operation, a first set of slots of the air shroud overlaps with a first set of slots, of a plurality of slots, of the nozzle, and wherein, in a second mode of operation of the at least two modes of operation, a second set of slots of the air shroud overlaps with a second set of slots of the plurality of slots of the nozzle, wherein a count of slots in the first set of slots is more than a count of slots in the second set of slots.

2. The fuel nozzle apparatus of claim 1 wherein the at least two modes of operation are selectable manually.

3. The fuel nozzle apparatus of claim 2 wherein the at least two modes of operation are selectable manually by manually actuating a selector switch or using a linkage driven by an actuator fixed to the selector switch.

4. The fuel nozzle apparatus of claim 1 wherein the at least two modes of operation are selectable automatically with an actuator in automatic mode dependent upon an availability of at least one fuel among the plurality of fuels.

5. The fuel nozzle apparatus of claim 1 wherein the nozzle comprises an adaptable fuel nozzle that facilitates a use of two gaseous fuels for a burner.

6. The fuel nozzle apparatus of claim 5 wherein either of the at least two modes of operation are triggered by a burner control system associated with the burner, thereby allowing the burner to transition from one fuel to another fuel among the two at least gaseous fuels automatically without a shutdown of the burner control system.

7. The fuel nozzle apparatus of claim 1 wherein the air is adjusted prior to a mixture of the air with the plurality of fuels.

8. The fuel nozzle apparatus of claim 1 wherein the plurality of fuels comprises different types of fuels.

9. The fuel nozzle apparatus of claim 1 wherein the air shroud is subject to a linear movement in an axial direction in which the position of the air shroud is varied linearly.

10. A fuel nozzle apparatus, comprising:

a nozzle that functions with at least two modes of operation with respect to a plurality of fuels; and an air shroud subject to a linear movement in an axial direction in which the position of the shroud is varied linearly, wherein the air shroud surrounds the nozzle and blocks air through the nozzle or allows air through the nozzle in a predefined pattern, wherein when a position of the air shroud is varied, an amount of the air and a location of the air into the nozzle is changed to facilitate the at least two modes of operation with respect to the plurality of fuels wherein, in a first mode of operation of the at least two modes of operation, a first set of slots of the air shroud overlaps with a first set of slots, of the plurality of slots, of the nozzle, and wherein, in a second mode of operation of the at least two modes of operation, a second set of slots of the air shroud overlaps with a second set of slots of the plurality of slots of the nozzle, wherein a count of slots in the first set of slots is more than a count of slots in the second set of slots.

11. The fuel nozzle apparatus of claim 10 wherein the at least two modes of operation are selectable manually by manually actuating a selector switch or using a linkage driven by an actuator fixed to the selector switch.

12. The fuel nozzle apparatus of claim 10 wherein the at least two modes of operation are selectable automatically with an actuator in automatic mode dependent upon an availability of at least one fuel among the plurality of fuels.

13. The fuel nozzle apparatus of claim 10 wherein the nozzle comprises an adaptable fuel nozzle that facilitates a use of two gaseous fuels for a burner.

14. The fuel nozzle apparatus of claim 13 wherein either of the at least two modes of operation is triggered by a burner control system associated with the burner, thereby allowing the burner to transition from one fuel to another fuel among the two at least gaseous fuels automatically without a shutdown of the burner control system.

15. A method of operating a fuel nozzle apparatus, comprising:

providing a nozzle that is configured to functions with at least two modes of operation with respect to a plurality of fuels wherein the nozzle is having a surface defining a plurality of slots to allow air into a combustion chamber;

surrounding an air shroud over the nozzle wherein the air shroud is having a surface defining a plurality of slots to allow air flow into the plurality of slots of wherein in a first mode of operation of the at least two modes of operation, a first set of slots of the air shroud overlaps with a first set of slots, of the plurality of slots, of the nozzle, and wherein, in a second mode of operation of the at least two modes of operation, a second set of slots of the air shroud overlaps with a second set of slots of the plurality of slots of the nozzle, wherein a count of slots in the first set of slots is more than a count of slots in the second set of slots; and varying a position of the air shroud wherein an amount of the air and a location of the air into the nozzle is changed to facilitate the at least two modes of operation with respect to the plurality of fuels.

16. The method of claim 15 wherein:

the at least two modes of operation are selectable manually by manually actuating a selector switch or using a linkage driven by an actuator fixed to the selector switch; or the at least two modes of operation are selectable automatically with an actuator in an automatic mode dependent upon an availability of at least one fuel among the plurality of fuels.

17. The method of claim 15 wherein:

the nozzle comprises an adaptable fuel nozzle that facilitates a use of two gaseous fuels for a burner; and either of the at least two modes of operation is triggered by a burner control system associated with the burner, thereby allowing the burner to transition from one fuel to another fuel among the two at least gaseous fuels automatically without a shutdown of the burner control system.

18. The method of claim 15 further comprising adjusting the air prior to a mixture of the air with the plurality of fuels.

19. The method of claim 15 wherein the plurality of fuels comprises different types of fuels.

20. The method of claim 15 further comprising subjecting the air shroud to a linear movement in an axial direction in which the position of the air shroud is varied linearly.

* * * * *